US008408929B2

(12) United States Patent
Solon

(10) Patent No.: US 8,408,929 B2
(45) Date of Patent: Apr. 2, 2013

(54) GUARD FOR CONNECTION POINT OF ADJOINED WIRE CONNECTORS

(75) Inventor: Dean Solon, Gallatin, TN (US)

(73) Assignee: Shoals Technologies Group, LLC, Portland, TN (US)

( * ) Notice: Subject to any disclaimer, the term of this patent is extended or adjusted under 35 U.S.C. 154(b) by 0 days.

(21) Appl. No.: 13/072,821

(22) Filed: Mar. 28, 2011

(65) Prior Publication Data

US 2012/0252258 A1 Oct. 4, 2012

(51) Int. Cl.
*H01R 13/639* (2006.01)

(52) U.S. Cl. ..... 439/301; 439/369

(58) Field of Classification Search ..... 439/301, 439/369, 367

See application file for complete search history.

(56) References Cited

U.S. PATENT DOCUMENTS 4,643,505 A * 2/1987 House et al. ..... 439/369
4,676,572 A * 6/1987 Booker ..... 439/301
4,849,580 A * 7/1989 Reuter ..... 174/92
5,099,088 A * 3/1992 Usami et al. ..... 174/76
5,259,782 A * 11/1993 Giffin ..... 439/367
7,189,100 B1 * 3/2007 Colbourne ..... 439/369
7,384,297 B2 * 6/2008 King et al. ..... 439/369
7,465,182 B1 * 12/2008 McDonald ..... 439/369
2004/0097120 A1 * 5/2004 Limber et al. ..... 439/369
2010/0255704 A1 * 10/2010 Gardner et al. ..... 439/301
2011/0275233 A1 * 11/2011 Benear ..... 439/278

* cited by examiner

*Primary Examiner* — Gary F. Paumen

(74) *Attorney, Agent, or Firm* — Carla Gannon Law

(57) ABSTRACT

A cylindrical guard is used for protecting the electrical junction between connectors. The guard is essentially two split cylindrical sections oriented end-to-end with breakaway tabs therebetween. The split cylindrical pieces are hinged, and substantially irreversibly lock together in a "clamshell" like fashion. The resulting guarded junction is less likely to be accidentally disengaged, thereby protecting both property and life. The guard can be removed by cutting, or broken and moved to expose the underlying junction by severing the breakaway tabs.

15 Claims, 9 Drawing Sheets

GUARD FOR CONNECTION POINT OF ADJOINED WIRE CONNECTORS

BACKGROUND (1) Field

The present invention relates generally to devices that protect wiring assemblies and, more particularly, to a hinged, split, tubular structure that irreversibly snaps onto the connection point of two adjoined wire connectors.

(2) Related Art

The invention discussed herein can be used with connectors disclosed in U.S. patent application Ser. No. 12/502,395, pertaining to "Low Leakage Electrical Joints and Wire Harnesses, and Method of Making the Same", filed on Jul. 14, 2009, which is hereby incorporated by reference.

Solar power has long been considered a niche utility. It is considered desirable from an environmental and political standpoint, but perhaps not economically feasible for generating enough power to make a meaningful contribution to the grid. However, as the problems associated with our dependence on fossil fuels have become better understood, more attention has been paid to so-called alternative energy such as solar power. This attention has led to significant technological and policy advances, such that solar power is now quite prevalent, and more economically feasible.

Technological advances in the generation of solar energy have occurred in multiple areas, including collector material and structure, and wiring infrastructure. In particular, certain advances in devices used in the electrical infrastructure have increased safety and reliability, while decreasing labor and cost. One example is the use of wire harnesses, male and female connectors, and low-leakage T, cross and Y joints. These devices facilitate correctly wiring a solar energy system using plug-and-play components, versus hard-wiring using conventional methods and materials such as wire, crimps, cutting, welding, testing, etc. This technology is explained in more detail in patent application Ser. No. 12/502,395.

It is advantageous if connectors, such as male and female connectors, can be easily engaged and disengaged because this facilitates on-the-fly wiring without having to measure, cut, weld, etc. However, this unfortunately also creates the possibility of inadvertent disengagement, especially when wiring architecture is above ground, as it commonly is, where people can trip on the wires. Such a disconnection may simply temporarily cut off one solar panel in an array, or may be catastrophic with respect to widespread damage to the system, or even risk of electrocution.

In addition, it is desirable that electrical standards are met to ensure compliance with code, as well as safety.

Thus, there remains a need for a new and improved device for guarding the connection point of two adjoined connectors. Preferably the device is inexpensive to manufacture and transport, and is quick and easy to use. Preferably this device locks into place and is difficult to accidentally remove. Most preferably the device is a hinged cylindrical structure constructed of plastic, that irreversibly engages to firmly grasp an electrical junction within the interior channel. Finally, preferably the device meets or exceeds the recommendations of the 2008 National Electrical Code, section 690.32(c).

SUMMARY OF THE INVENTIONS

The present invention is directed to a guard that quickly fits around the junction of joined connectors. The guard is essentially two cylinders which are joined in an end-to-end orientation with a tabbed gap there between, to form one discontinuous cylinder. The resulting longitudinally split, discontinuous cylinder has a hinge joining two halves of the cylinder longitudinally, and spaced irreversibly locking mechanisms joining the other halves of the cylinder when the cylinder is in the closed position. The tabs connecting the two cylinders can be intentionally broken, but are strong enough to prevent accidental exposure of the surrounded junction.

Accordingly, one aspect of the present inventions is to provide a connector guard that is easy to use and prevents accidental disengagement of connectors. It is also an aspect of the present inventions to provide a device that can be quickly and easily removed when desired, by using common electrical tools. Another aspect is to be able to expose the underlying connector without actually removing the invention, by twisting the device. Another aspect is providing frictional grips within the device to prevent the connection from slipping around.

These and other aspects of the present inventions will become apparent to those skilled in the art after a reading of the following description of the preferred embodiment when considered with the drawings.

DESCRIPTION OF THE PREFERRED EMBODIMENTS

Figure 1:
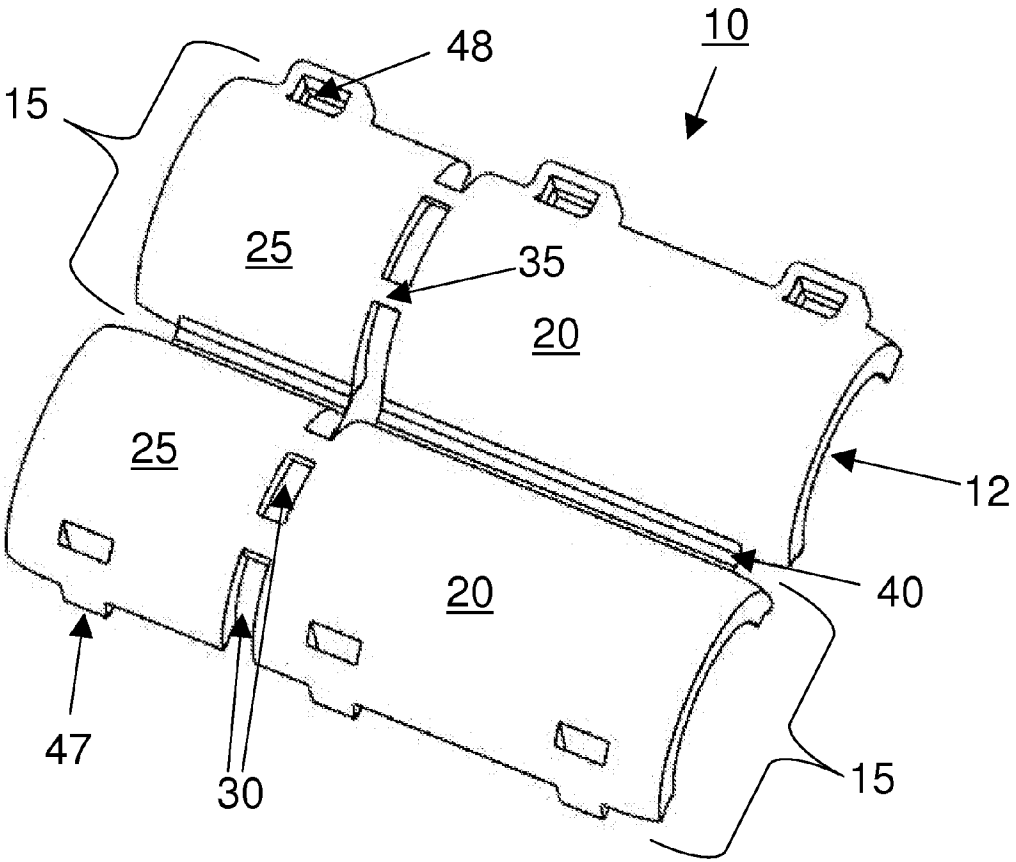
FIG. 1 is a perspective view of the exterior of a preferred embodiment of the invention shown in the open position.

In the following description, like reference characters designate like or corresponding parts throughout the several views. It should be understood that the illustrations are for the purpose of describing a preferred embodiment of the inventions and are not intended to limit the inventions thereto.

As best seen in FIG. 1, guard 10 generally includes two semi-cylindrical sections 15, 15, that are joined together at hinge 40. As used herein "semi-cylindrical" conceptually refers to approximately half, or approximately 180°, of a generally cylindrical or tubular structure that has been longitudinally divided. It should be understood that "semi-cylindrical" does not preclude breaks in symmetry such as planar sections or the addition of structures such as locking mechanisms, tabs and the like. Semi-cylindrical sections 15, 15 each include large section 20 and small section 25, which are connected to each other by at least one tab 35. Two tabs per section 15, for a total of four tabs per guard 10, is preferred. Large and small sections 20, 25 define gap 30 therebetween, with tabs 14 connecting sections 20, 25 across gap 30. Tabs 35 are preferably breakaway tabs, which, as use herein, are tabs that provide suitable strength to maintain integrity with regular use, but are specifically designed to "breakaway", or be broken, with the application of a minimum amount of human effort, either with or without standard electrical tools. In particular, when guard 10 is in situ, for example see FIG. 7, a user can grasp large section 20 in one hand, small section 25 in the other hand, and rotate the sections in opposite directions to sever tabs 35, then pull the connectors away from each other, to expose the electrical junction underneath.

Figure 2:
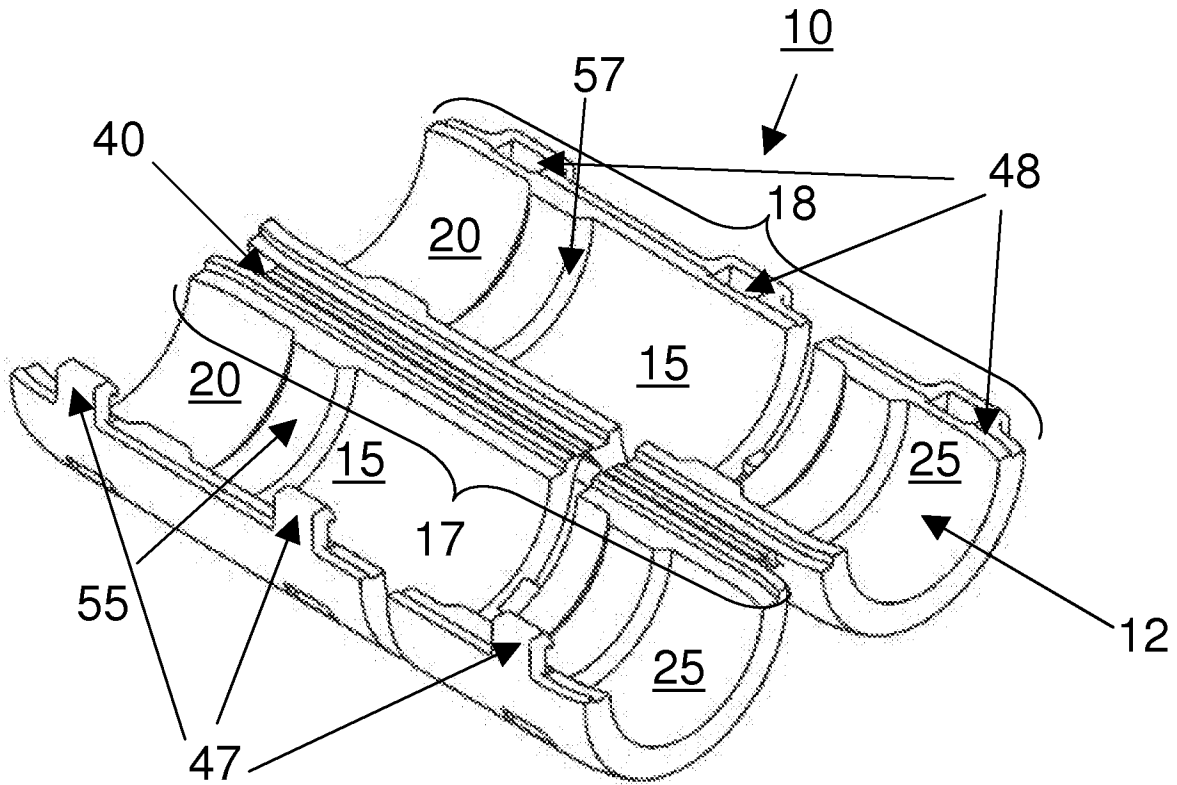
FIG. 2 is a perspective view of the interior of a preferred embodiment of the invention shown in the open position.
Figure 3:
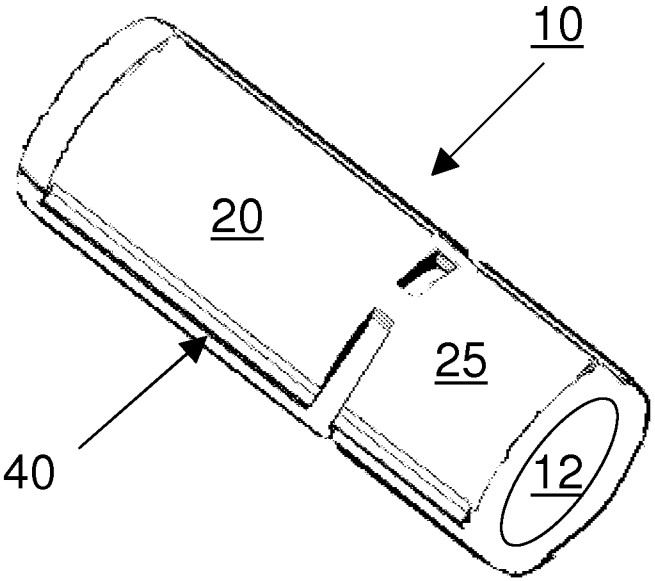
FIG. 3 is a perspective view of a preferred embodiment of the invention shown in the closed position.
Figure 4:
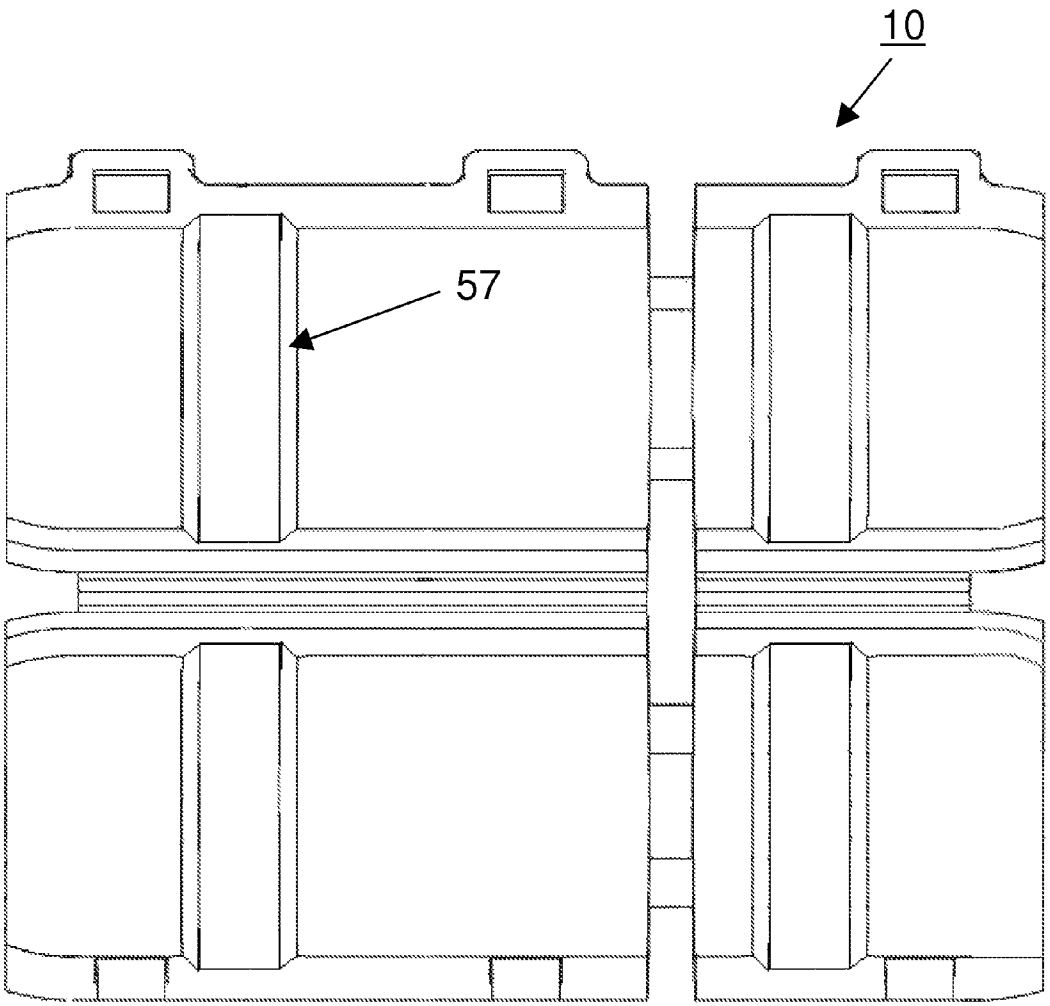
FIG. 4 is a plan view of the interior of a preferred embodiment of the invention shown in the open position.
Figure 5:
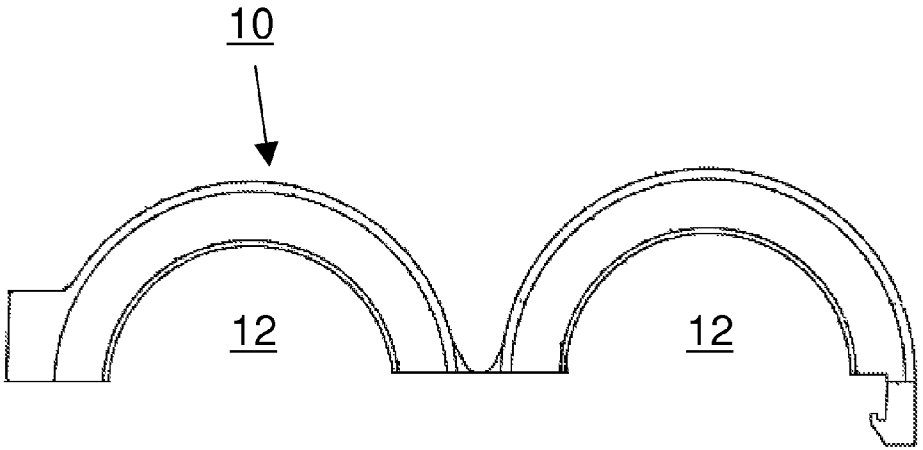
FIG. 5 is a side view of the invention shown in the open position.
Figure 8:
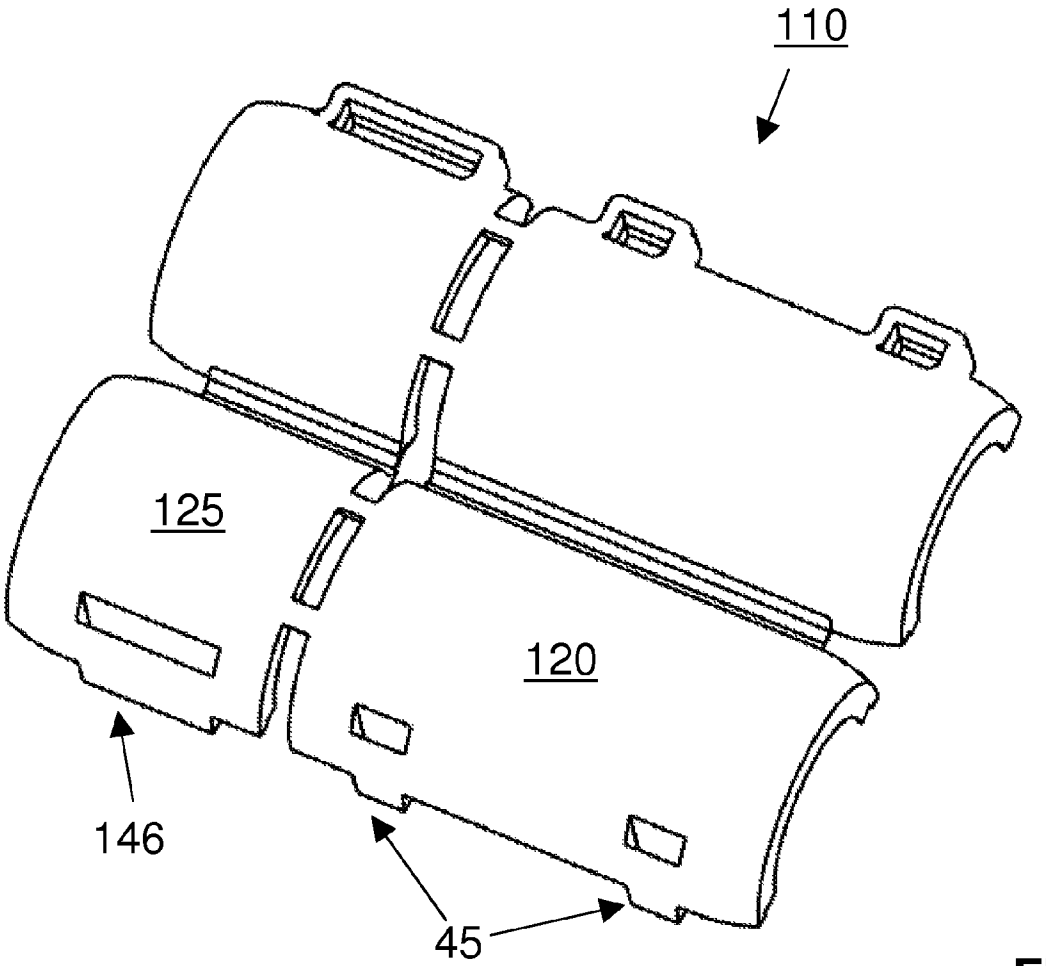
FIG. 8 is a perspective view of the exterior of an alternative embodiment of the invention shown in the open position.

Referring to FIG. 2, semi-cylindrical sections 15, 15 each include proximal longitudinal edge 17, which abut hinge 40, and distal longitudinal edge 18, away from hinge 40. Hinge 40 is preferably constructed of the same material as the remainder of guard 10, thereby lending the device to injection molding or other known methods of economical mass production. Distal longitudinal edges 18 include locking mechanisms that are aligned so that mating portions, for example locking tab 47 and locking aperture 48, (collectively locking mechanism 45) connect upon closure of guard 10. While locking tab and aperture 47, 48 are preferred, other locking mechanisms known in the art, such as latches, or ball and sockets, would also be suitable. Locking mechanism 45 is preferably capable of irreversible engagement. As used herein, "irreversible engagement" refers to engagement wherein a user would not be able to "unlock" the mechanism, or otherwise "undo" the engagement in regular use, without using unusual force or the assistance of tools. In the most preferred embodiment, large section 20 includes two locking mechanisms 45 and small section 25 includes one locking mechanism, with all locking mechanisms 45 identical. This orientation is shown in FIG. 1. However, as depicted in FIG. 8, alternative guard 110 could include elongated locking mechanism 146 on alternative small section 125, and two identical locking mechanisms 45 on alternative large section 120.

Figure 6:
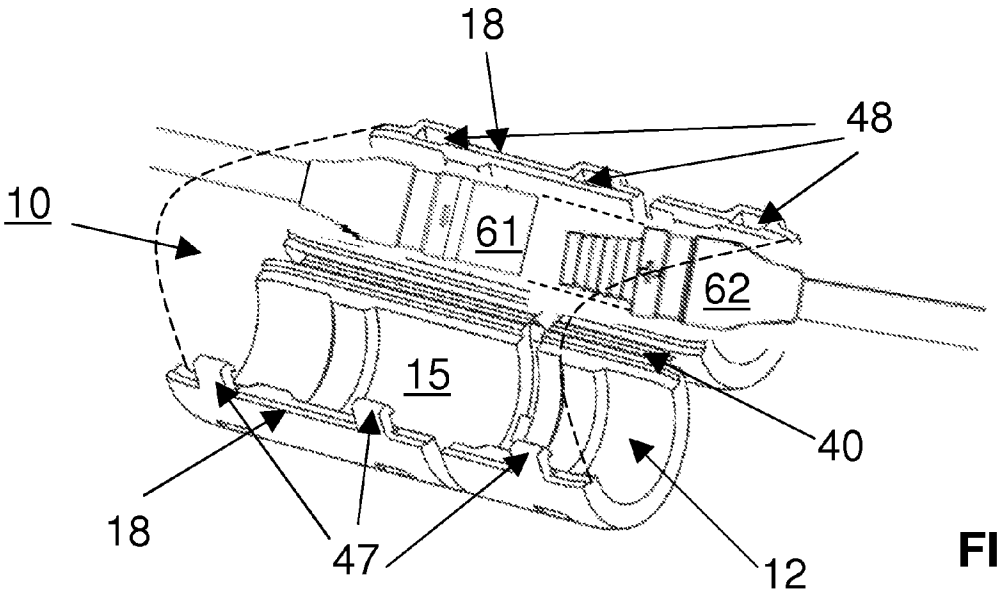
FIG. 6 schematically shows disengaged connectors positioned in the channel of the invention in the open position.
Figure 7:
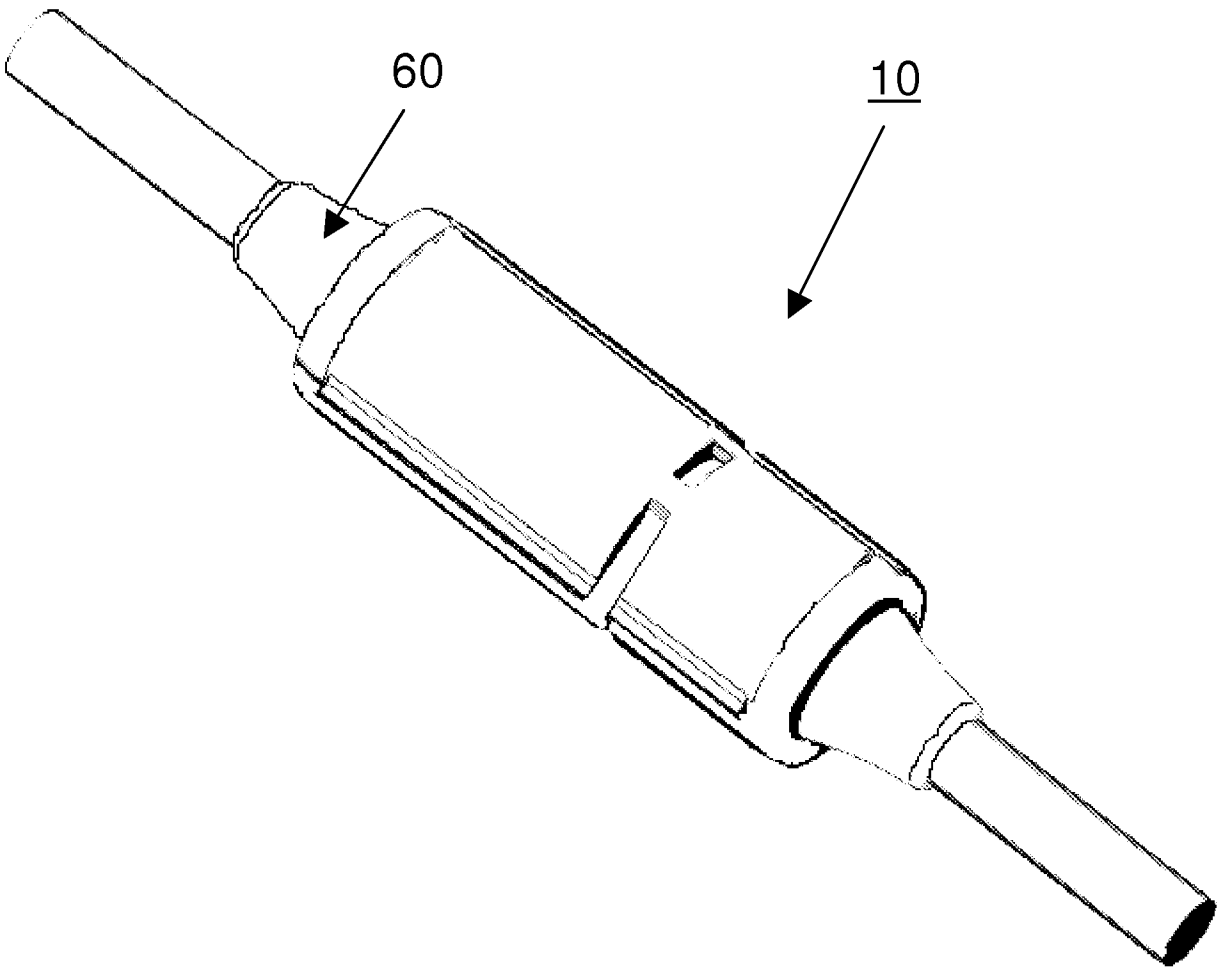
FIG. 7 is a perspective view of the invention with connectors guarded inside.
Figure 9:
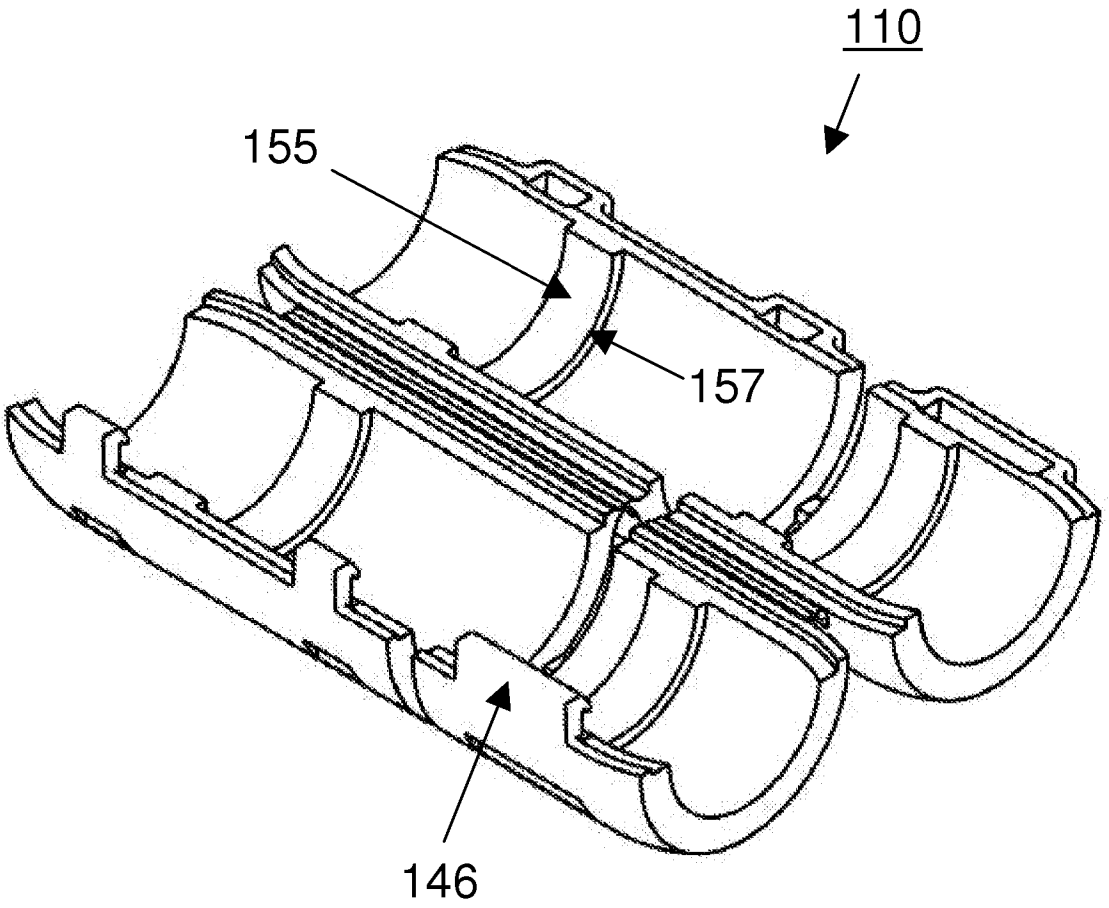
FIG. 9 is a perspective view of the interior of an alternative embodiment of the invention shown in the open position.
Figure 10:
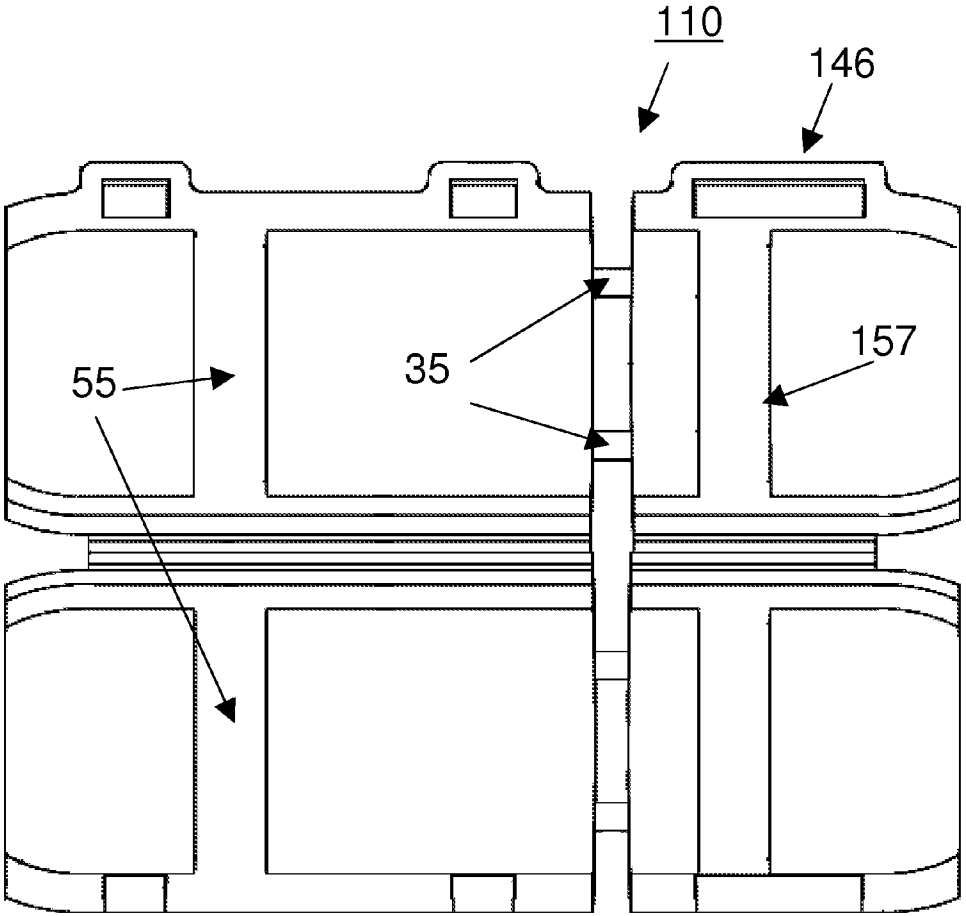
FIG. 10 is a plan view of the interior of an alternative embodiment of the invention shown in the open position.

Referring back to FIG. 2, the interior portions of semi-circular sections 15 define at least one semi-circumferential rib 55, with each large section 20 and each small section 25 preferably defining one rib 55, for a total of four ribs 55. Ribs 55 are oriented so that upon closure of guard along axis of hinge 40, rib sections 55 align in end-to-end orientation, thereby forming "rings" within channel 12 of guard 10. Ribs 55 exert additional frictional pressure on electrical connectors 60 within channel 12, thereby maintaining the longitudinal position of the junction held within. This is generally shown in FIG. 6. Said another way, ribs 55 help prevent connector 60 from slipping within channel 12, as shown in FIG. 7. In the preferred embodiment, rib 55 includes chamfer 57, (FIG. 2) but straight wall 157 is also possible, as shown in alternative guard 110 (FIG. 9).

Referring now to FIG. 6, in use, one would connect female connector 61 to male connector 62, then circumferentially surround the resulting connection, or junction, in guard 10 by rotating one semi-cylindrical section 15 around the axis of hinge 40, thereby bringing distal longitudinal edges 18 together, and engaging locking tabs 47 with locking apertures 48. The resulting orientation is depicted in FIG. 7. To remove the guard 10, a user would preferably employ cutters to cut off guard 10. As discussed above it is also possible to expose junction by twisting to sever breakaway tabs 35.

Guard 10 is preferably constructed of Polypropylene using known techniques such as injection molding.

Guard 10 meets meet the recommendations of the 2008 National Electrical Code, section 690.32(c). More specifically, a preferred embodiment was tested according to IEC61646 Damp Heat and UL1703 Thermal Cycling Testing, 3rd Edition, dated Mar. 15, 2002 with revisions through and including Apr. 8, 2008. This protocol is hereby incorporated in its entirety.

Certain modifications and improvements will occur to those skilled in the art upon a reading of the foregoing description. By way of example, it is possible to vary the number of clips, the number of breakaway tabs, the width of the breakaway tabs, the length of the device, the profile of the inside surface of the device, the design of the hinge, the material of the device, and/or the thickness of the material. It is also possible to eliminate the hinges so the device is two halves that snap together. It should be understood that all such modifications and improvements have been deleted herein for the sake of conciseness and readability but are properly within the scope of the following claims.

I claim:

1. A guard for the connection point of adjoining connectors, said guard comprising:

A) a first semi-cylindrical section including a first proximal longitudinal edge and a first distal longitudinal edge, said first semi-cylindrical section defining a first gap, said first gap apportioning said first semi-cylindrical section into a first large section and a first small section spanned therebetween with at least one breakaway tab;

B) a second semi-cylindrical section including a second proximal longitudinal edge and a second distal longitudinal edges;

C) a hinge connecting said first proximal longitudinal edge to said second proximal longitudinal edge;

D) a first locking mechanism adjacent said first distal longitudinal edge; and

E) a second locking mechanism adjacent said second distal longitudinal edge, said first and second closing mechanisms engageable one with the other.

2. The guard of claim 1 wherein said second semi-cylindrical section defines a second gap, said second gap apportioning said first semi-cylindrical section into a second large section and a second small section spanned therebetween with at least one tab.

3. The guard of claim 1 wherein the interior side of said first semi-cylindrical section includes a first semi-circumferential rib.

4. The guard of claim 3 wherein the interior side said second semi-cylindrical section includes a second semi-circumferential rib aligned end-to-end with said first semi-circumferential rib.

5. The guard of claim 1 wherein said first and second locking mechanisms irreversibly engage.

6. A protected low current, high voltage connection, said connection comprising:

A) a female connector including a first plug;

B) a male connector including a second plug, said first and said second plugs engaged at a junction; and C) a substantially cylindrical guard, said guard including a large section and a small section connected by at least one breakaway tab, and said guard circumferentially surrounding said junction.

7. The connection of claim 6 wherein said guard includes a locking mechanism.

8. The connection of claim 7 wherein said locking mechanism is capable of substantially irreversible engagement.

9. The connection of claim 6 wherein said large section includes a first rib, said first rib frictionally maintaining the longitudinal position of said junction.

10. The connection of claim 9 wherein said small section includes a second rib, said second rib frictionally maintaining the longitudinal position of said junction.

11. A method of protecting an electrical connection comprising the acts of:

A) positioning a first semi-cylindrical section of a guard having a large section and a small section connected by at least one breakaway tab beneath a junction of two connectors;

B) rotating a second semi-cylindrical section of said guard to a position above said junction; and C) engaging said first and said second semi-cylindrical sections.

12. The method of claim 11 wherein the act of rotating a second semi-cylindrical section includes rotation about the axis of a hinge shared by said first and said second semi-cylindrical sections.

13. The method of claim 11 wherein the act of engaging said first and second semi-cylindrical sections includes effectuating an irreversible engagement.

14. The method of claim 11 wherein the act of engaging said first and second semi-cylindrical sections includes engaging more than one locking mechanism.

15. The guard of claim 2 wherein said at least one tab is a breakaway tab.

* * * * *